US007396206B2

(12) United States Patent
Humhauser

(10) Patent No.: US 7,396,206 B2
(45) Date of Patent: Jul. 8, 2008

(54) ARRANGEMENT FOR AXIALLY AND RADIALLY FIXING THE GUIDE VANES OF A VANE RING OF A GAS TURBINE

(75) Inventor: Werner Humhauser, Moosburg (DE)

(73) Assignee: MTU Aero Engines GmbH, Munich (DE)

( * ) Notice: Subject to any disclaimer, the term of this patent is extended or adjusted under 35 U.S.C. 154(b) by 45 days.

(21) Appl. No.: 10/515,597

(22) PCT Filed: May 15, 2003

(86) PCT No.: PCT/DE03/01568

§ 371 (c)(1),
(2), (4) Date: Jun. 20, 2005

(87) PCT Pub. No.: WO03/102379

PCT Pub. Date: Dec. 11, 2003

(65) Prior Publication Data

US 2005/0238490 A1 Oct. 27, 2005

(30) Foreign Application Priority Data

May 28, 2002 (DE) ..... 102 23 655

(51) Int. Cl.
*F01D 9/02* (2006.01)

(52) U.S. Cl. ..... 415/209.3; 415/211.2

(58) Field of Classification Search ..... 415/209.3, 415/209.4, 210.1, 191, 211.2
See application file for complete search history.

(56) References Cited

U.S. PATENT DOCUMENTS

| | | | | | |
|---|---|---|---|---|---|
| 2,654,566 | A | | 10/1953 | Boyd et al. | |
| 3,104,091 | A | | 9/1963 | Dennis et al. | |
| 3,363,416 | A | | 1/1968 | Heybyrne et al. | |
| 3,992,126 | A | * | 11/1976 | Brown et al. | 415/115 |
| 4,329,113 | A | * | 5/1982 | Ayache et al. | 415/116 |
| 4,889,469 | A | * | 12/1989 | Wilkinson | 415/191 |
| 5,201,846 | A | | 4/1993 | Sweeney | |
| 5,399,069 | A | | 3/1995 | Marey et al. | |
| 5,441,385 | A | * | 8/1995 | Boyd et al. | 415/209.2 |
| 6,095,750 | A | | 8/2000 | Ross et al. | |

FOREIGN PATENT DOCUMENTS

| | | |
|---|---|---|
| DE | 843 700 | 7/1949 |
| EP | 0 161 203 B1 | 6/1988 |
| EP | 0 526 058 B1 | 2/1996 |
| GB | 1 523 422 A | 8/1978 |

* cited by examiner

*Primary Examiner*—Ninh H Nguyen
(74) *Attorney, Agent, or Firm*—Crowell & Moring LLP

(57) ABSTRACT

A gas turbine has at least one guide blade ring, whose guide vanes are axially and radially fixed via detachable locking elements. A shell ring is configured as a freely machinable component having projections bearing a stop surface and mating surfaces. A holding piece is provided for each guide vane, which engages into corresponding recesses on an upstream shell ring. The holding pieces are held in a position determined by the locking elements, via spring clips.

14 Claims, 2 Drawing Sheets

ARRANGEMENT FOR AXIALLY AND RADIALLY FIXING THE GUIDE VANES OF A VANE RING OF A GAS TURBINE

BACKGROUND AND SUMMARY OF THE INVENTION

This application claims the priority of German patent document 102 23 655.0, filed May 28, 2002 (PCT International Application No.: PCT/DE03/01568, filed May 15, 2003), the disclosure of which is expressly incorporated by reference herein.

The invention concerns an arrangement for axially and radially fixing the guide vanes of a guide vane ring of a gas turbine.

Gas turbine configurations are known in which the stator of the gas turbine does not form an integral unit, but has critical connecting and support points with reference to a gap that must be maintained. Fixing arrangements must be provided, which take into consideration the temperature gradients that occur between the turbine housing and the guide baffle ring, the realization of which can cause considerable difficulties. As a consequence of confined space conditions and poor accessibility, the milling work on the stop surface located on the turbine housing for providing the required fixing arrangements can be achieved only with great effort. This applies not only in the case of the first installation, but also to repair and restoration work as a consequence of wear during the operation of these gas turbines.

One object of the present invention is to provide a new configuration for the means for fixing the guide vanes of a guide vane ring of a gas turbine.

This and other objects and advantages are achieved by the fixing arrangement according to the invention, in which the milling work required to establish the necessary proportions and the gap is moved to the shell rings and holding pieces that are separated from the turbine housing via new form-fitting locking elements. The latter are assigned to the end of the guide vanes of the guide vane lattice and are farthest from the hub, with their contact surfaces, which determine the play and the position of the guide vanes; and the shell rings and holding pieces are consequently better accessible for machining and for repair and restoration work.

The guide vanes can also be joined by means of new locking elements before installation in the turbine to form a module, thereby providing a simple partner interface and considerably simplifying assembly. Moreover, the new locking elements make possible in particular an almost play-free fixing of the guide vane rings directly on the spoke centering device, while eliminating the annular seals which were previously necessary. Arrangement of the support points on the shell rings decouples the spoke centering device from the turbine housing, thereby preventing deformations of the turbine housing that occur during the operation of the gas turbine from directly influencing the spoke centering device. Finally, the usual casting on of the mounting points of the so-called "outer air seals" can be eliminated with the new locking elements.

Other objects, advantages and novel features of the present invention will become apparent from the following detailed description of the invention when considered in conjunction with the accompanying drawings.

DETAILED DESCRIPTION OF THE DRAWINGS

Figure 1:
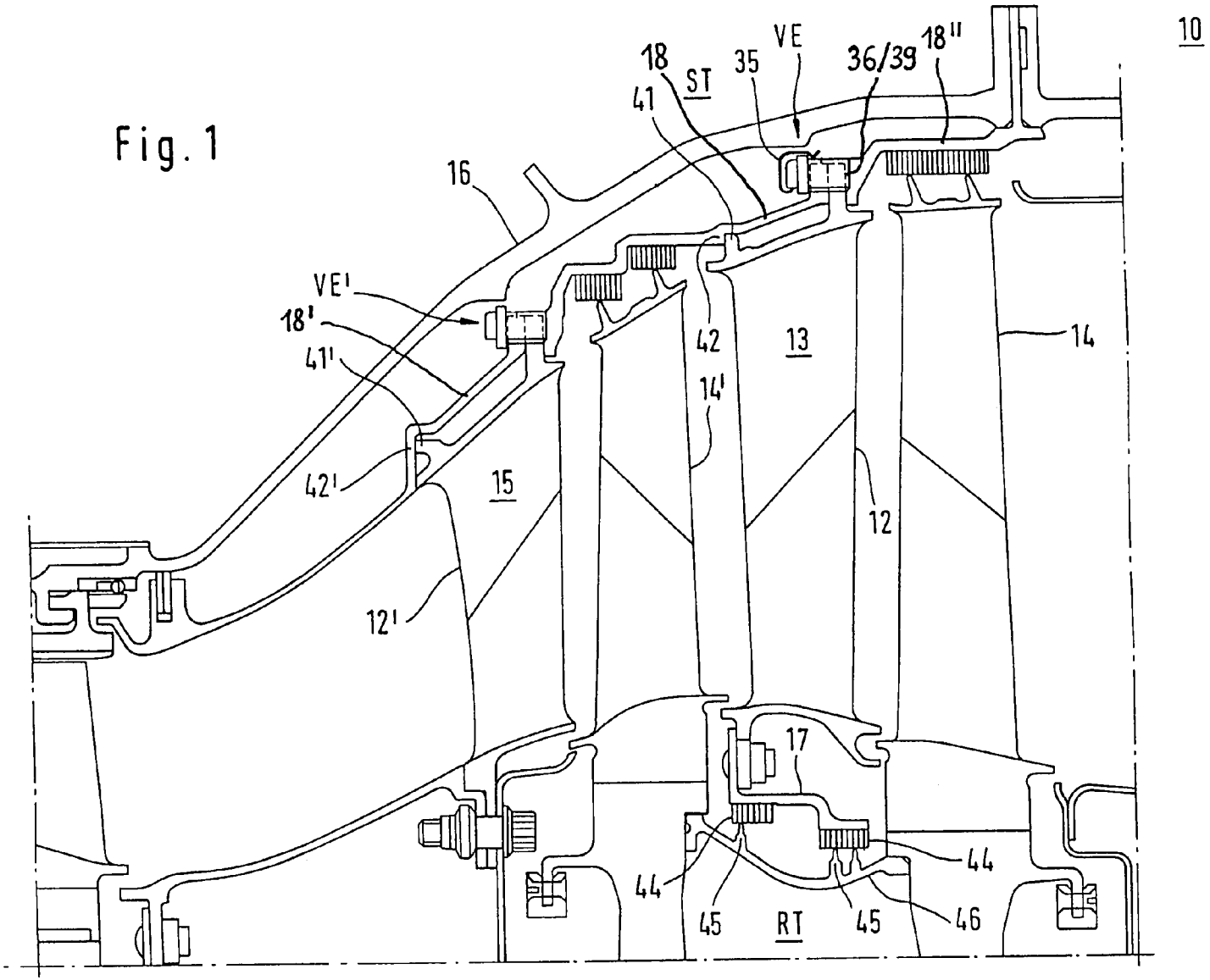
FIG. 1 shows a section through the low pressure part of a gas turbine comprising guide vane rings and moving blade rows.

The low pressure part of a gas turbine 10 is depicted in section in FIG. 1, with a stator ST having guide vanes 12, 12' a rotor RT having guide vanes 14, 14', and the corresponding turbine housing 16. The guide vanes and moving blades are joined into so-called guide vane rings and moving blade rows, which together with their corresponding components (explained in more detail below) form so-called partner components (namely the mentioned stator and the mentioned rotor, of the gas turbine 10 enclosed in the turbine housing 16).

As shown in FIG. 1, the guide vane ring 13 formed by the guide vanes 12 projects between two moving blade rows with their moving blades 14 and 14'. Another guide vane ring 15 having guide vanes 12' is fixed upstream between the hub and the housing. The guide vane ring 13 (located in a manner described below) between the turbine housing 16 and a seal bracket 17 of the stator ST is subjected to dilations caused by the temperature gradients, which are absorbed by defined gaps.

Figure 2:
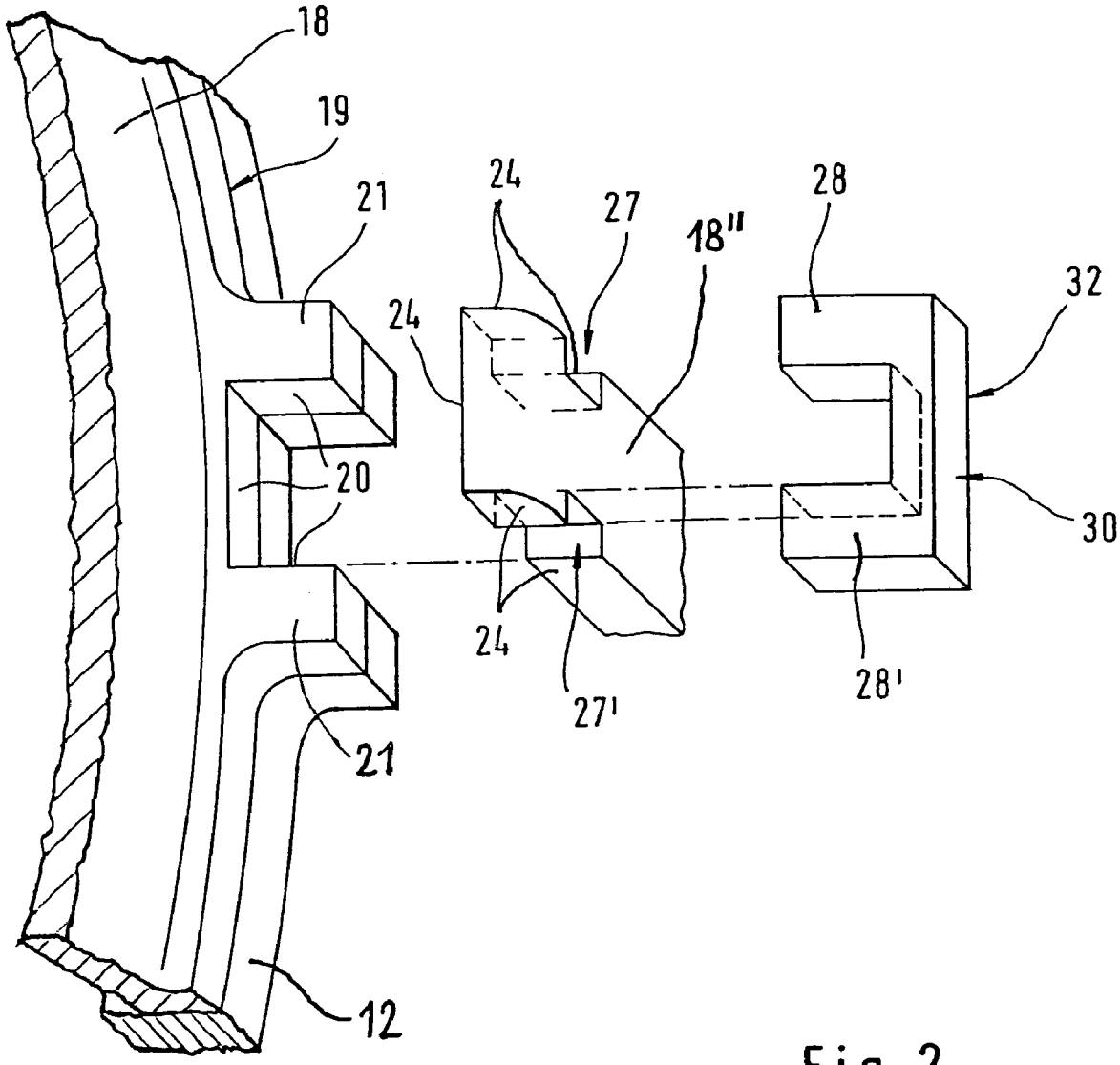
FIG. 2 is an enlarged exploded representation of the locking elements of the invention assigned to the guide vane tips of the guide vane ring.

The locking elements shown in FIG. 2, which are each assigned to the end of a guide vane 12 facing away from the hub, are provided as fixing means. These locking elements comprise a shell ring 18 for the guide vane ring 13 with an axial stop surface 19 and with radial projections 21 including pairs of planar mating surfaces 20 for the purpose of receiving the corresponding planar bearing surfaces 24 on an upstream shell ring 18". An axial extension of the shell ring 18" (best seen in FIG. 2) has also mutually opposite right-angled recesses 27 and 27' on both sides, for accommodating the legs 28, 28' of a U-shaped holding piece 30. Each holding piece 30 has on its rear base a support surface 32, behind which engages a spring clip 35 (shown in FIG. 1 and described below) after the guide vanes have been installed on the turbine housing. In the operational position, the guide vanes 12 with their corresponding mating surfaces are aligned with the mating surfaces 20 of the projections 21 of the shell ring 18, and the latter is in axial contact with its stop surface 19 with the guide vanes 12. The holding pieces 30 that engage in the recesses 27 and 27' by means of the legs 28, 28' fix the guide vanes 12 and the shell ring 18 on the shell ring 18", so that the latter is located and fixed on the turbine housing.

In this way a form-fitting locking mechanism (designated by VE, VE' in FIG. 1) is formed directly at the location of the usual spoke centering device, and is secured for each guide vane via the spring clip 35. For this purpose, the spring clips 35 engage with their free ends under the internal radial bearing surfaces 24 on the shell ring 18", particularly on its axial extension.

The guide vane tips also have projections 41, 41', to which are assigned corresponding stop surfaces 42, 42' on the shell rings 18, 18'. The ends of the guide vanes 12 that face the seal bracket 17 of the stator ST bear seal coatings 44, whose assigned sealing fins 45 are arranged on the rotor part 46.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. In a gas turbine having a turbine housing, and guide vane rings and moving blade rows arranged axially side by side, an arrangement for axially and radially fixing guide vanes of the guide vane ring wherein stop surfaces of the guide vanes that serve for fixation are held in place by locking elements, which are structurally separate from the turbine housing; wherein:

the locking elements are assigned to radially outer ends of the guide vanes farthest from a hub of the turbine;

said locking elements engage in a form-fitting manner with each other; and said locking elements comprise shell rings having respectively two axial stop surfaces, holding pieces that engage into respective corresponding recesses of the shell rings, and spring clips that engage with inner surfaces of said shell rings and with support surfaces of said holding pieces, and retain said holding pieces in said recesses of said shell rings.

2. The arrangement of claim 1, wherein radial and circumferential mating surfaces of the shell ring are arranged on radial projections, to which are assigned corresponding contact surfaces on the outer radial ends of the guide vanes.

3. The apparatus according to claim 1, wherein said shell rings collectively form an enclosure that bounds a gas flow path of said turbine.

4. The apparatus according to claim 3, wherein said locking elements comprise an axially extending portion of each said shell ring which portion is configured to engage with radial projections on an adjacent shell ring.

5. The apparatus according to claim 4, wherein said holding pieces comprise substantially U-shaped members having arms that engage in corresponding recesses in said axially extending portions of said shell rings.

6. The apparatus according to claim 5, wherein said spring clips engage with inward surfaces of said axially extending portion and said support surfaces of said holding pieces.

7. The apparatus according to claim 5, wherein said spring clips engage with inward surfaces of said axially extending portion and said support surfaces of said holding pieces.

8. The apparatus according to claim 4, wherein said holding pieces comprise substantially U-shaped members having arms that engage in corresponding recesses in said axially extending portions of said shell rings.

9. In a gas turbine having a turbine housing, and guide vane rings and moving blade rows arranged axially side by side, an arrangement for axially and radially fixing guide vanes of the guide vane ring wherein stop surfaces of the guide vanes that serve for fixation are arranged on locking elements, which are structurally separate from the turbine housing; wherein:

the locking elements are assigned to radially outer ends of the guide vanes farthest from a hub of the turbine;

said locking elements engage in a form-fitting manner with each other; and said locking elements comprise shell rings having respectively two axial stop surfaces and holding pieces, which engage into respective corresponding recesses of the shell rings and serve as support surface for a spring clip;

radial and circumferential mating surfaces of the shell ring are arranged on radial projections, to which are assigned corresponding contact surfaces on the outer radial ends of the guide vanes;

spring clips engage on the support surfaces of the holding pieces; and corresponding bearing surfaces on the shell ring are assigned to the spring clips to detachably fix the holding pieces.

10. A gas turbine, comprising:

a turbine housing;

guide vane rings and moving blade rows arranged alternately in axial sequence within said housing;

fixing means for axially and radially fixing guide vanes of the guide vane ring within said housing; wherein, said fixing means comprise stop surfaces of the guide vanes;

said stop surfaces are provided on locking elements that are structurally separate from the turbine housing;

the locking elements are assigned to radially outer ends of the guide vanes farthest from a hub of the turbine;

said locking elements engage in a form-fitting manner with each other; and said locking elements comprise shell rings having respectively two axial stop surfaces, holding piece that engage into respective corresponding recesses of the shell rings, and spring clips that engage with inner surfaces of said shell rings and with support surfaces of said holding pieces, and retain said holding pieces in said recesses of said shell rings.

11. The arrangement of claim 10, wherein radial and circumferential mating surfaces of the shell ring are arranged on radial projections, to which are assigned corresponding contact surfaces on the outer radial ends of the guide vanes.

12. The apparatus according to claim 10, wherein said shell rings collectively form an enclosure that bounds a gas flow path of said turbine.

13. The apparatus according to claim 12, wherein said locking elements comprise an axially extending portion of each said shell ring which portion is configured to engage with radial projections on an adjacent shell ring.

14. A gas turbine, comprising:

a turbine housing;

guide vane rings and moving blade rows arranged alternately in axial sequence within said housing;

fixing means for axially and radially fixing guide vanes of the guide vane ring within said housing; wherein, said fixing means comprise stop surfaces of the guide vanes;

said stop surfaces are provided on locking elements that are structurally separate from the turbine housing;

the locking elements are assigned to radially outer ends of the guide vanes farthest from a hub of the turbine;

said locking elements engage in a form-fitting manner with each other;

said locking elements comprise shell rings having respectively two axial stop surfaces and holding pieces which engage into respective corresponding recesses of the shell rings;

radial and circumferential mating surfaces of the shell ring are arranged on radial projections, to which are assigned corresponding contact surfaces on the outer radial ends of the guide vanes;

spring clips engage on the support surfaces of the holding pieces; and corresponding bearing surfaces on the shell ring are assigned to the spring clips to detachably fix the holding pieces.

* * * * *